US006182307B1

(12) United States Patent
Rutrick

(10) Patent No.: US 6,182,307 B1
(45) Date of Patent: Feb. 6, 2001

(54) WALL MOUNTED HEADBOARD FOR A BED

(76) Inventor: Julius Rutrick, 2542 Young Ave., Bronx, NY (US) 10469

( * ) Notice: Under 35 U.S.C. 154(b), the term of this patent shall be extended for 0 days.

(21) Appl. No.: 09/386,727

(22) Filed: Aug. 31, 1999

(51) Int. Cl.[7] ..... A47C 31/00
(52) U.S. Cl. ..... 5/53.1; 5/280; D6/505
(58) Field of Search ..... 5/53.1, 183, 280, 5/285, 907; D6/505, 506

(56) References Cited

U.S. PATENT DOCUMENTS

| | | | | |
|---|---|---|---|---|
| D. 255,522 | | 6/1980 | Quigley | D6/505 |
| D. 267,839 | | 2/1983 | Lenger | D6/506 |
| 2,508,506 | * | 5/1950 | Fridolph | 5/280 |
| 2,687,537 | * | 8/1954 | Wallace et al. | 5/53.1 X |
| 3,736,603 | * | 6/1973 | Rothman | 5/53.1 |
| 4,821,349 | | 4/1989 | Cohen | 5/53.1 |
| 4,903,354 | | 2/1990 | Yeh | 5/53.1 |
| 5,195,195 | | 3/1993 | Murray | 5/53.1 |
| 5,269,032 | | 12/1993 | Flocks | 5/285 |

FOREIGN PATENT DOCUMENTS

| | | | | |
|---|---|---|---|---|
| 803611 | * | 10/1958 | (GB) | 5/53.1 |

* cited by examiner

*Primary Examiner*—Terry Lee Melius
*Assistant Examiner*—Robert G. Santos
(74) *Attorney, Agent, or Firm*—Herbert Dubno

(57) ABSTRACT

A headboard for a bed provided with cleats is removably mounting the headboard on a wall above the bed. The headboard has a frame receiving a paneling with a cane cushion, over which a fabric can be drawn and held in place by adhesive strips on the back of the panel. Swivels can lock the panel in place.

8 Claims, 5 Drawing Sheets

WALL MOUNTED HEADBOARD FOR A BED

FIELD OF THE INVENTION

My present invention relates to a wall mounted headboard for a bed and, more particularly, to a headboard for a bed whose appearance can be changed from time to time and which may be used for thematic decor, to match bedding, drapes, carpeting or other decorative materials in a bedroom and which can be easily mounted and dismounted.

BACKGROUND OF THE INVENTION

Bed headboards have been provided in a variety of forms and in many cases have been mounted on a wall above a bed, particularly in institutional, such as motel and hotel applications. The headboard can be fitted onto a bed frame as well. There have been numerous proposals for thematic headboards, i.e. headboards which are intended to convey a particular decorative impression or sense. For example, in U.S. Pat. No. D 267 839, the headboard has a dolls house configuration.

Headboards may be capable of alteration to suit the development of a child, for example, being modified thematically as the child develops from infanthood to adolescence to the young adult. Fabric covered headboards are also known in which the fabric is drawn over a frame and fastened, e.g. by staples, tacks or the like on the backside of the frame. Headboards can thus be customized to suit the user and, since the fabric can be changed from time to time employed to display different fabric patterns. Attention is directed in this respect to U.S. Pat. Nos. 4,821,349, 5,195, 195 and 5,269,032. Convertible furniture or furniture which is intended to accommodate an individual through various ages is known in a variety of forms (see U.S. Pat. No. 5,173,974 and the patent documents cited therein).

The following patents also are relevant to frame structures, headboards and the like:

U.S. Pat. Nos. 2,641,779, 2,844,829, 3,116,569, 3,256, 533, 3,351,960, 5,269,032, 5,659,991, and 5,791,752.

Notwithstanding the extensive art in frame constructions, bed headboards and the like, there has remained a need for a convertible headboard which can be accommodated to the need of the household and to the different requirements as the user ages or alters his or her esthetic ideas and which can be readily modified by an unskilled person in such manner that the appearance of the headboard is professional.

OBJECTS OF THE INVENTION

It is, therefore, the principal object of the present invention to provide an improved convertible headboard which overcomes drawbacks of earlier headboards and can easily be modified by the user without professional assistance to yield a product which is custom designed by the householder himself or herself and yet has a fully professional appearance.

Another object of this invention is to provide an improved headboard for a bed which can be modified to have practically any desired appearance without the need for complex upholstering steps like stapling or tacking fabric in place.

SUMMARY OF THE INVENTION

These objects and others which will become apparent hereinafter are attained, in accordance with the invention in a headboard for a bed which comprises:

a panel formed with a board, a cane cushion on one side of the board, and a strip of adhesive on an opposite side of the board and extending along edges thereof for engagement with a replaceable fabric adapted to be placed over the cushion and folded about the edges onto the adhesive strip;

a frame receiving the panel and having frame limbs extending along the edges, a ledge upon which the panel is supported in the frame, and an opening bounded by the limbs through which the cane cushion or the fabric is visible; and a multiplicity of swivels spaced along the limbs and pivotal between positions in which each of the swivels overhangs the strip to retain the panel in the frame and in which the swivels are swung out of engagement with the panel to permit the panel to be removed from the frame.

Advantageously, that headboard is mounted on a wall above a bed utilizing a cleat on the back of the panel which engages a cleat or bar previously mounted on the wall, the cleat and bar being shaped so that the bar engages behind the cleat and retains the panel on the wall, together with the frame attached thereto, until the headboard is lifted from the bar.

According to another feature of the invention, the bar and cleat have mutually engaging bevels. In an important feature of the invention, the panel is formed with nonadhesive islands along the adhesive strip where the swivels can swing over the adhesive, these islands permitting movement of the swivels between the engaged and disengaged positions without being impeded by the adhesive of the strip in the absence of the fabric. When, of course, the fabric is present, the fabric will lie between the swivel and the adhesive. The islands can be disks of a silicone anti-adhesive material and the adhesive strip can be a doubly adhesive tape, i.e. a tape which is adhesive on both of its surfaces.

The headboard of the invention can utilize a molded picture frame as its frame member and the panel, which is padded with foam and covered with open cane, can be used without upholstery. It has been found to be comfortable to lean against and highly esthetic. However, when need or conditions change it can be easily converted into a fabric coated panel by simply removing the panel from the frame, stretching a fabric over the cane cushion and adhering the fabric edges to the adhesive strip on the back of the panel. When the panel is replaced in the frame and the multiplicity of swivels are swung to overlie the edge of the fabric on the adhesive strip, the swivels not only hold the panel in place but retain the fabric against the adhesive.

It has been found that mistakes are often made in selecting upholstery to match bedding. With the system of the invention, the headboard fabric can be readily altered when it becomes soiled or when a change is required for matching the headboard to the bedding. There is no need for tacking or nailing.

In an application of the headboard to the needs of children, it is possible to use a printed fabric with images ranging from cartoon, fairy tale or stylized animal characters, to sports figures, to sophisticated artwork or designs as the child develops from infant to adolescent to young adult to adult.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
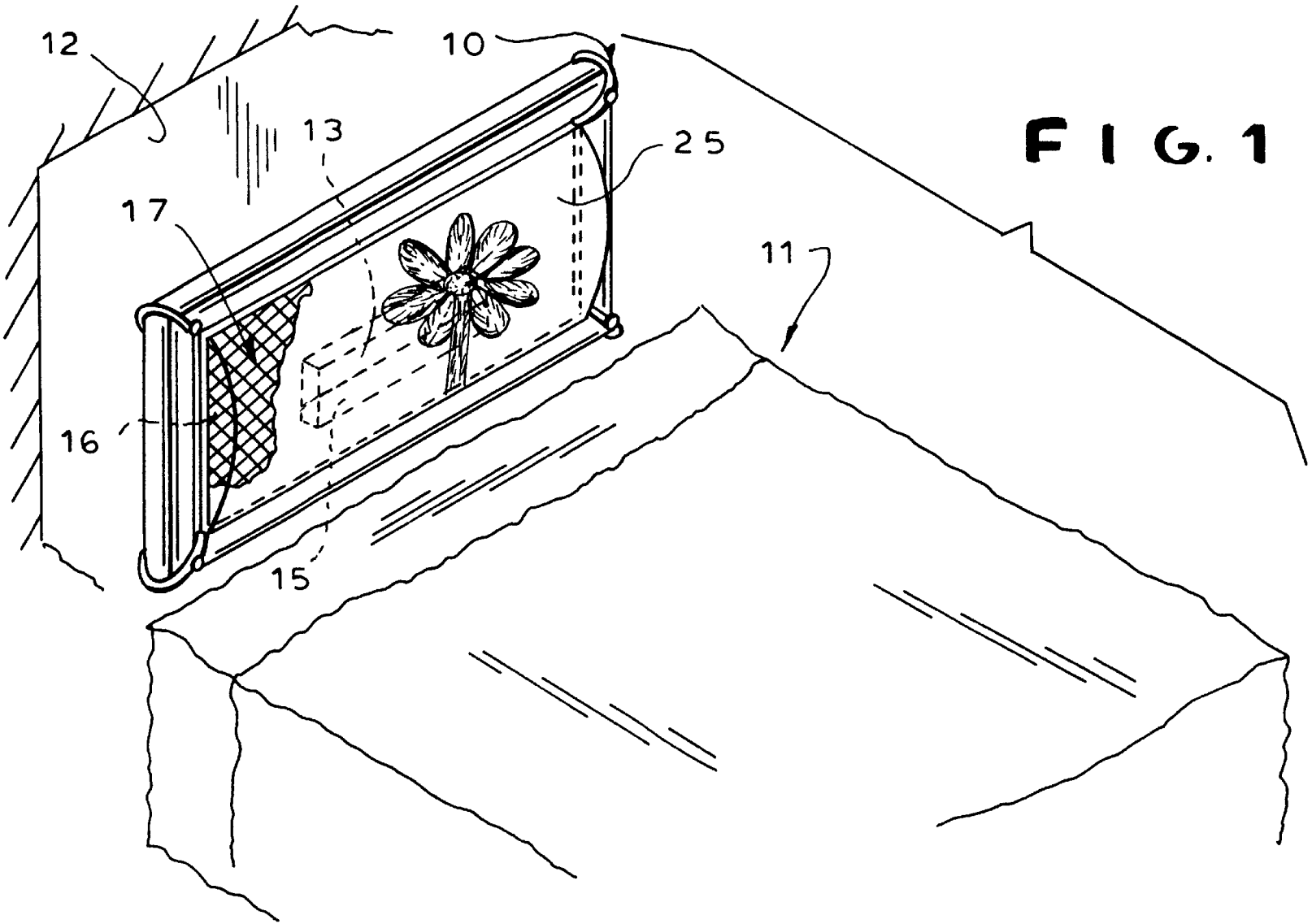
FIG. 1 is a diagrammatic perspective view of a convertible headboard according to the invention.
Figure 2:
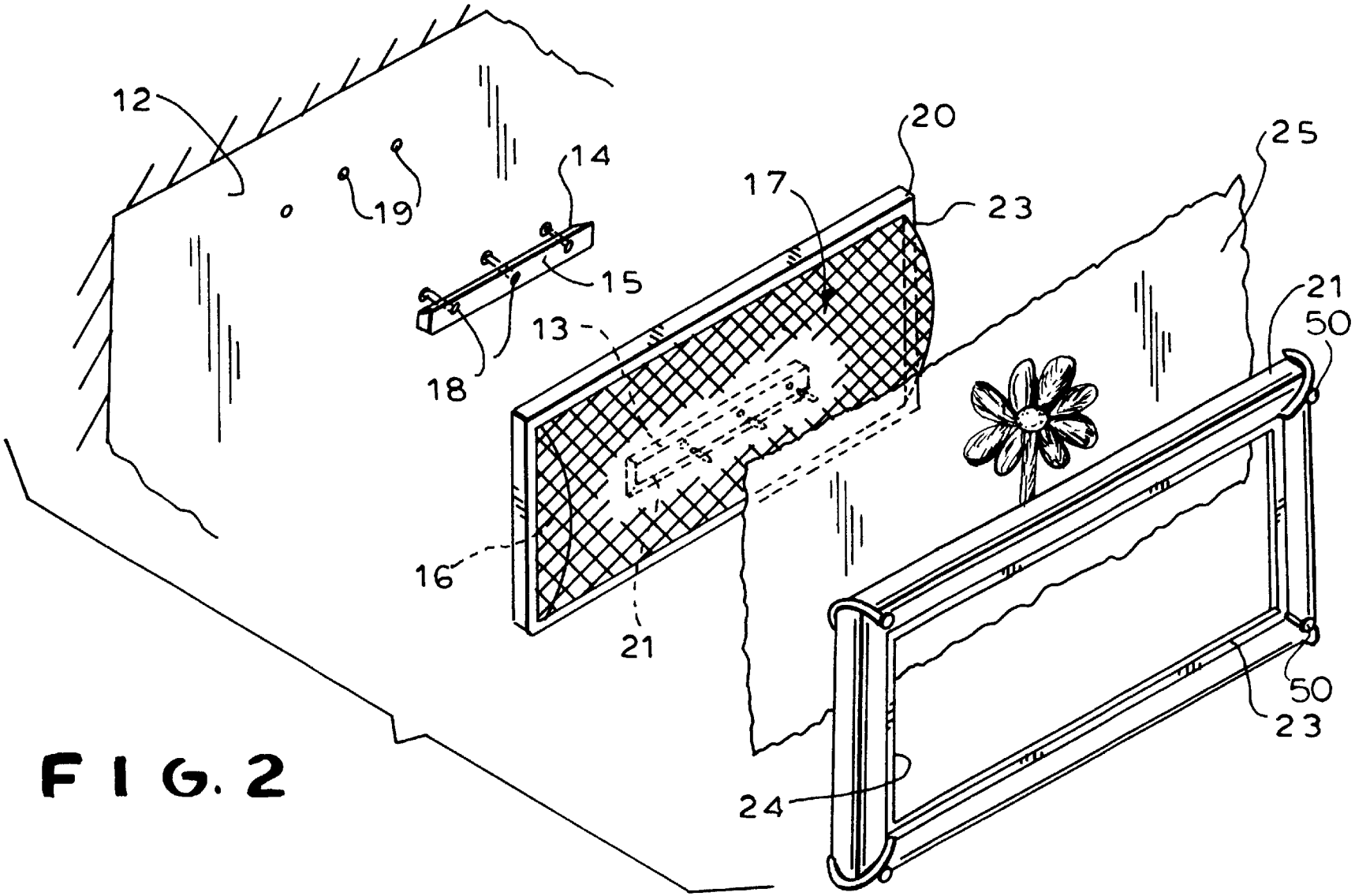
FIG. 2 is an exploded view illustrating the principles of the headboard.

In FIG. 1 I have shown a headboard 10 for a bed 11, the headboard being directly mounted on a wall 12. For that purpose, a horizontal cleat 15 is previously affixed to the wall, e.g. by screws and anchors, and has a bevelled portion 14 over which engages an oppositely bevelled cleat 13 affixed to the rear panel of the headboard 10. The latter is formed with a cushion 16 covered in cane 17 and over which a fabric 25 with any desired pattern can be placed. A layer 25' of a soft material can be provided between the fabric 25 and the cane 17. The cushion itself is composed of a foamed synthetic resin. As can be seen from FIG. 2, the wall cleat 15 can have holes 18 through which screws can pass to anchors 19 in the wall 12, the bevel 14 being upwardly and outwardly away from the wall. The cleat 13 on the panel 20 of the headboard has a downwardly and rearwardly extending bevel 21 engageable over the bevel 14. The cushion 16 is attached to the panel 20 by the cane cover 17 or by any conventional upholstery method.

The panel 20 fits into a frame 21 having a ledge 22 against which the edge portion 23 of the panel can rest so that the cushion and cane can project through the opening 24 of the frame. The fabric 25, which is optional, can be pulled over the cane covering 17 when it is desired to change the appearance of the headboard.

Figure 3:
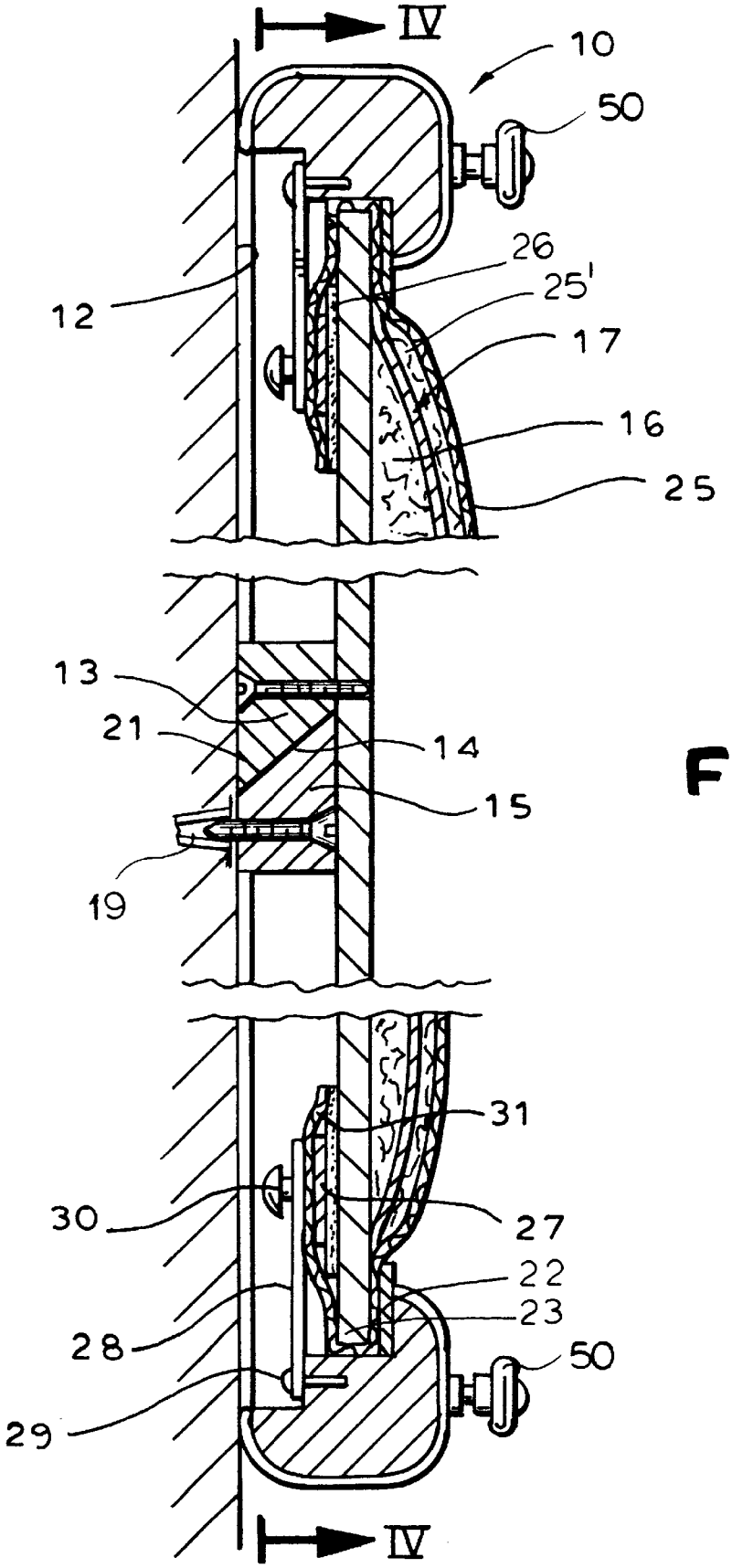
FIG. 3 is a cross sectional view through the headboard mounted on a wall.
Figure 4:
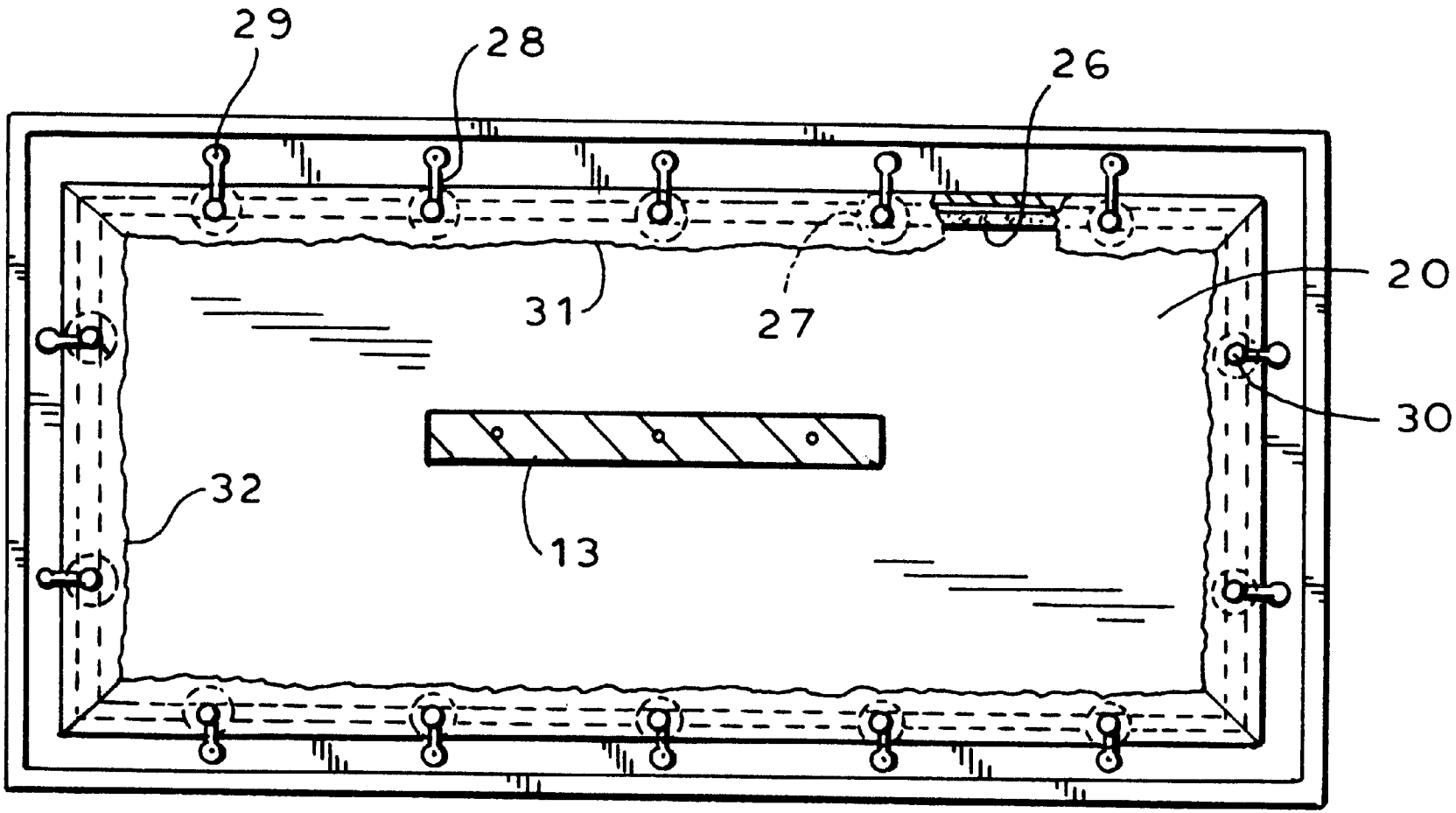
FIG. 4 is a view of the rear of the headboard, partly broken away along line IV—IV of FIG. 3.
Figure 5:
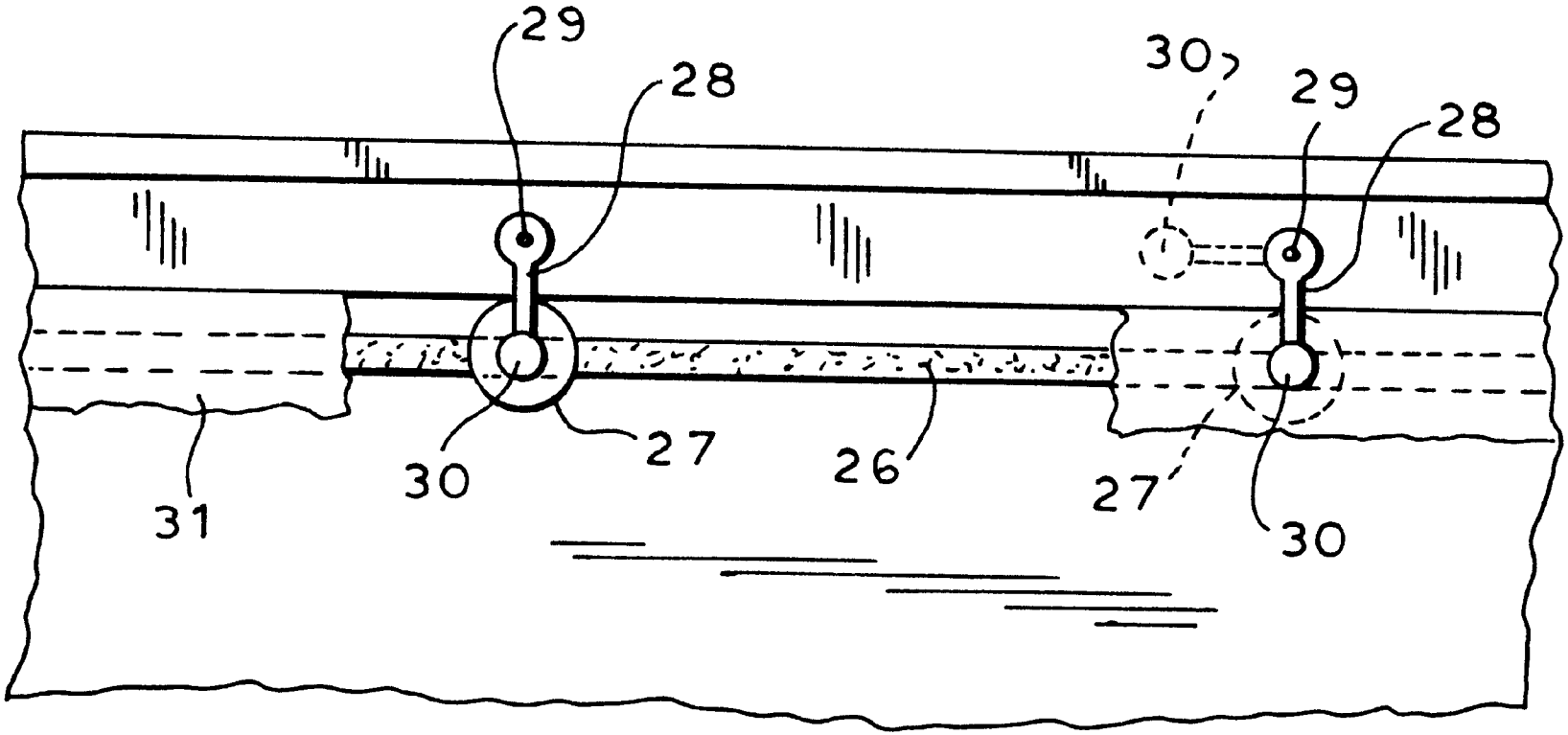
FIG. 5 is a detail view of the swivel system for the headboard.

As can be 'seen from FIGS. 3 through 5, the back of the panel 20 is provided, all around its perimeter, with an adhesive strip 26 and at spaced apart locations with silicone disks 27 overlying the adhesive and preventing the swivels 28 from hanging up on the adhesive when the swivels are rotated. Each of the swivels is pivotally connected at 29 to the frame and has a button 30 which can be gripped by the user to enable the swivel to be swung from a position in which the swivel lies parallel to the respective frame limb into a position in which the swivel holds the panel 20 in place. When no fabric 25 is provided to cover the cane cushion, the swivels 28 which are spaced apart along all of the framed limbs, overlie the silicone disks 27 and retain the panel in place against the ledge 22. When, however, a fabric has been drawn over the cane cushion, the fabric is adhered to the back of the panel by the adhesive strip 26 and is additionally held in place by the swivels 28 which overlie the folded-over strips 31 and 32 of the fabric (see FIGS. 4 and 5).

As a consequence, the headboard of the invention can be considered to be convertible from the open cane appearance to the fabric covering which can be any upholstery or other decorative fabric. Of course, a change back to cane is always possible simply by removing the panel from the frame and stripping the fabric from the adhesive. No tacking, nailing or stapling is needed to re-cover the headboard. To match the headboard to the bed linen, a piece of fabric can be cut from a sheet of the bed linen pattern and simply pressed down onto the pressure sensitive tape and drawn over the cane cushion. The panel is then locked into the frame by turning the swivels.

The entire headboard can be simply lifted onto or removed from the wall cleat.

The convertible headboard of the invention can be used for the bed of a child and will grow with the child with changes in the pattern from a juvenile to those more satisfying to the young adult or an adult. The printed fabric, for example, may initially carry a picture of a teddy bear, then possibly a reproduction of a Disney character then possibly a power ranger and then possibly some sports figure or illustration. The bed can be moved without disturbing the headboard.

An important advantage of the use of cane in the cushion is that it provides a generic decor compatible with most interior decors and bedding if patterns of an original bedding may be no longer available.

When the headboard is turned over on a table or other supporting surface to access the rear thereof, it is supported on the corner posts 50.

What is claimed is:

1. A headboard for a bed, comprising:

a panel formed with a board, a cane cushion on one side of said board, and a strip of adhesive on an opposite side of said board and extending along edges thereof for engagement with a replaceable fabric adapted to be placed over said cushion and folded about said edges onto said adhesive strip;

a frame receiving said panel and having frame limbs extending along said edges, a ledge upon which said panel is supported in said frame, and an opening bounded by said limbs through which said cane cushion or said fabric is visible;

a multiplicity of swivels spaced along said limbs and pivotal between positions in which each of said swivels overhangs said strip to retain said panel in said frame and in which said swivels are swung out of engagement with said panel to permit said panel to be removed from said frame; and a horizontal cleat on said other side of said panel for mounting said headboard on a wall, said cleat being engageable with a wood bar mounted upon the wall.

2. The headboard defined in claim 1 wherein said bar and said cleat have mutually engaging bevels.

3. The headboard defined in claim 1 wherein said adhesive strip is a strip of double backed adhesive tape.

4. The headboard defined in claim 1 wherein said panel and said frame are rectangular.

5. A headboard for a bed, comprising:

a panel formed with a board, a cane cushion on one side of said board, and a strip of adhesive on an opposite side of said board and extending along edges thereof for engagement with a replaceable fabric adapted to be placed over said cushion and folded about said edges onto said adhesive strip;

a frame receiving said panel and having frame limbs extending along said edges, a ledge upon which said panel is supported in said frame, and an opening bounded by said limbs through which said cane cushion or said fabric is visible; and a multiplicity of swivels spaced along said limbs and pivotal between positions in which each of said swivels overhangs said strip to retain said panel in said frame and in which said swivels are swung out of engagement with said panel to permit said panel to be removed from said frame, said panel is formed with nonadhesive islands along said strip engageable by said swivels in an absence of said fabric for facilitating movement of said swivels between said positions.

6. The headboard defined in claim 5 wherein said islands are disks of a silicone antiadhesive material.

7. The headboard defined in claim 5 wherein said adhesive strip is a strip of double packed adhesive tape.

8. The headboard defined in claim 5 wherein said panel and said frame are rectangular.

* * * * *